US006305468B1

(12) United States Patent
Broome et al.

(10) Patent No.: US 6,305,468 B1
(45) **Date of Patent: *Oct. 23, 2001**

(54) DOWNHOLE SCREEN AND METHOD OF MANUFACTURE

(75) Inventors: John T. Broome, The Woodlands; Benn A. Voll, Houston, both of TX (US); Gary Corbett, Aberdeen (GB); Jim Goodson, Porter; Yusheng Yuan, Houston, both of TX (US); Elmer R. Peterson, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/322,099

(22) Filed: May 28, 1999

(51) Int. Cl.[7] ..... E03B 3/22

(52) U.S. Cl. ..... 166/233; 166/230; 210/499; 29/896.62

(58) Field of Search ..... 166/230, 232, 166/233, 228; 210/497.1, 499; 29/896.61, 896.62

(56) References Cited

U.S. PATENT DOCUMENTS

| | | | | |
|---|---|---|---|---|
| 1,229,437 | * | 6/1917 | Foster | 166/230 |
| 1,623,055 | * | 4/1927 | Johnson | 166/231 |
| 2,487,888 | | 11/1949 | Moehrl . | |
| 3,168,924 | | 2/1965 | Anderson . | |
| 4,343,358 | | 8/1982 | Gryskiewicz . | |
| 4,365,669 | | 12/1982 | Wagner et al. . | |
| 4,378,294 | | 3/1983 | Wagner et al. . | |
| 4,649,996 | * | 3/1987 | Kojicic et al. | 166/228 |
| 4,767,426 | * | 8/1988 | Daly et al. | 55/487 |
| 5,456,317 | | 10/1995 | Hood, III et al. . | |
| 5,611,399 | * | 3/1997 | Richard et al. . | |
| 5,664,628 | * | 9/1997 | Kochler et al. | 166/369 |
| 5,823,260 | * | 10/1998 | McConnell et al. | 166/230 |
| 5,849,188 | * | 12/1998 | Voll et al. . | |
| 5,855,242 | | 1/1999 | Johnson . | |

FOREIGN PATENT DOCUMENTS

| | | |
|---|---|---|
| 0 186 317 A1 | 7/1986 | (EP) . |
| 2277947A | 11/1994 | (GB) . |
| 1534184 A1 | 1/1990 | (RU) . |

OTHER PUBLICATIONS

Houston Well Screen Company brochure, "Endrua–Pak", 9 pages, (date unknown).*

3M Ceramic Fiber Products brochure, "3M Nextel Ceramic Fabric Offers Space Age Protection", 4 pages, 1997.*

* cited by examiner

*Primary Examiner*—William Neuder
*Assistant Examiner*—Zakiya Walker
(74) *Attorney, Agent, or Firm*—Steve Rosenblatt

(57) ABSTRACT

A method and apparatus for manufacturing any given length of a completion filter assembly is described. An outer perforated jacket is assembled over the filter media, which is itself placed over a coarse support screen or drainage layer. In the preferred embodiment, the drainage layer and outer jacket have end rings such that when advanced through a die are pushed together with the filter media in between to effect a seal of the subassembly. The subassembly can then be placed on a support pipe which is perforated, and if metallic, the end rings are welded to the support pipe to complete the assembly. Optionally, many of the components can be made of materials which lend buoyancy to the assembly so that when it is advanced into a long lateral, it will float to assist in its proper positioning.

19 Claims, 2 Drawing Sheets

DOWNHOLE SCREEN AND METHOD OF MANUFACTURE

FIELD OF THE INVENTION

The field of this invention relates to screen assemblies for downhole completions, particularly to control production of sand.

BACKGROUND OF THE INVENTION

In the past, there has been a need to control sand or other solids produced from the formation with the flowing oil or other hydrocarbons. Techniques for sand control have involved the use of screens. Various configurations have been attempted for sand-control screens. These screens have generally involved a rigid base pipe which is perforated, overlaid by one or more layers of screen of different opening sizes. Generally, the finest screen, which is the one that is designed for catching the sand or other solid material, is a screen most prone to not only plugging but also other mechanical ailments.

In the past, these fine filtering screens have used very thin wire wrapped around the base pipe and an underlying coarser screen. The filtering screen has generally in the past had a welded longitudinal seam which failed generally due to erosive effects of the flow through the screen or chemical attack on the weldment. Sealing off the ends of the filtering screen to the underlying support structure has also been problematic. Again, due to the fine wire size of the filtering screen, welding the ends to a support body has resulted in failures due to differential expansion creating tensile loads on welds involving fine wire components of the filtering screen. Various mechanical efforts to seal the filtering screen to the underlying structure, such as by use of mechanical bands, has also failed to provide a tight seal, thereby allowing the hydrocarbons to short circuit around the filtering screen, carrying the undesirable sand with them.

In the past, underlying coarse screens below the sand-filtering screen have been made with a wound wire having a triangular cross-section, with a flat side oriented outwardly. This has resulted in coarse screens with fairly small open areas and created numerous dead spots behind the filtering screen where the flat side of the triangularly cross-section wound wire of the underlying coarser screen butted up against the openings of the finer sand-filtering screen. As a result, the sand-filtering screen suffered from losses of efficiency due to the numerous dead spots encountered by the outer flat side of the wound coarse screen broadly abutting the sand-filtering screen.

U.S. Pat. No. 5,611,399 provides a finished assembly that does not suffer from welded attachments to thin members, which had in the past been a weak point in resisting stress, particularly due to tensile loading, flow erosion, as well as chemical attack. It also creates an efficient sand-control screen assembly by employing a substrate of a coarse screen, having wound wires of a more rounded or arcuate cross-section, to reduce the dead zones in between the filtering screen and the underlying coarse screen. It also provides a simple mechanical technique for assembling the elements of the screen.

U.S. Pat. No. 5,611,399 illustrates a sand-filtering screen-making technique which involves an initial assembly of the sand-filtering screen over an underlying coarse screen. The sand-filtering screen has a mechanical longitudinal fold and overlap-type joint. End caps are fitted over the filtering screen which has already been preassembled to the underlying coarse screen. The assembly is then mechanically forced through a die to compress the end caps into the assembled filtering screen and underlying coarse screen. That subassembly is then assembled onto a base pipe and secured. An outer shroud can then be secured to the underlying base pipe, overlaying the filtering screen. The ends of the subassembly comprising the filtering screen and the underlying coarse screen are sealed against the support pipe by a packing gland arrangement at both ends.

This design, although an improvement over prior designs, still had several limitations. Packing glands were required to accommodate relative movement due to thermal effects. This would present potentials for leakage at seals. The crimping assembly, involving overlapping of the ends and folding them over, created a thick longitudinal seam which tended to decrease the given inside diameter for a given outside diameter. The annular gap in such a design, between the outer protective jacket and the filtering components, also limited the differential pressures that could be withstood across this screen.

Thus, some of the objectives of the present invention are to provide a design that could withstand greater differential pressures than prior designs. Another objective is to be able to form the assembly so that the fold overlapping of the prior art can be eliminated, thus enabling the use of a larger inside diameter for a given outside diameter. Another objective is to eliminate the floating end rings used in the prior art and secure the filter directly to a supporting base pipe. Yet another objective is to provide a technique which will allow low-cost manufacturing of the filter assembly. Another objective is to be able to hold the filter media in place with the outer jacket that is pushed on to it in the extrusion process. Another objective is to provide for an assembly that allows for use of nonmetallic components such that in long laterals, the assembly will actually induce buoyancy (cause less drag/friction during installation) to allow it to be more easily advanced into position for subsequent production. These and other advantages will be more apparent to those skilled in the art from a review of the preferred embodiment described below.

SUMMARY OF THE INVENTION

A method and apparatus for manufacturing any given length of a completion filter assembly is described. An outer perforated jacket is assembled over the filter media, which is itself placed over a coarse support screen or drainage layer. In the preferred embodiment, the drainage layer and outer jacket have end rings such that when advanced through a die are pushed together with the filter media in between to effect a seal of the subassembly. The subassembly can then be placed on a support pipe which is perforated, and if metallic, the end rings are welded to the support pipe to complete the assembly. Optionally, many of the components can be made of materials which lend buoyancy to the assembly so that when it is advanced into a long lateral, it will cause less drag or friction to assist in its proper positioning.

DETAILED DESCRIPTION OF THE PREFERRED EMBODIMENT

Figure 1:
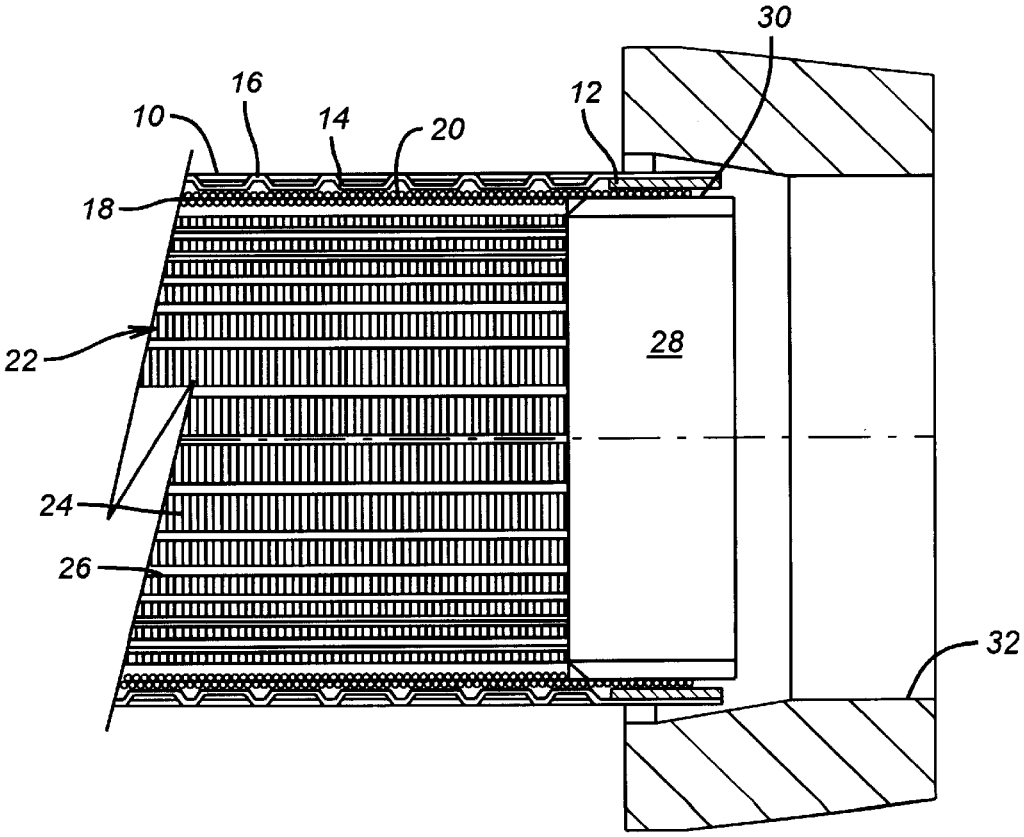
FIG. 1 shows in sectional cross-section the subassembly prior to advancement through a die.

The preferred embodiment is illustrated in FIG. 1. An outer shroud 10 has an end ring 12. It has a similar end ring on the other end, which is not shown. The structure of the outer shroud 10 is a tubular perforated member whose preferred construction is illustrated in U.S. Pat. No. 5,849,188 as a jacket 16. Referring to FIGS. 5*a* and 5*b* of that patent, which is incorporated here as if fully set forth, the jacket can be formed by a spiral pattern of punched in protrusions 14 which define opposing flowpaths from the outer surface 16 through openings such as 18 in order to reach the next layer, which is the filter material 20. The preferred structure of the filter material 20 is also illustrated in U.S. Pat. No. 5,849,188 as item 14. Below the filter material 20 is a coarse filter 22 which is essentially formed of an elongated material 24 which can have a variety of cross-sectional shapes, spirally wound so as to create a continuing spiral gap between each winding as the windings are supported on longitudinally oriented support rods 26. The coarse filter may also be woven to create said gap. The end of the structure can optionally contain a solid ring 28. The filter material 20 is rolled into a tubular shape and the ends are minimally overlapped on each other. One of the ends, shown in FIG. 1 as item 30, winds up being between ring 28 and ring 12 on outer shroud 10.

The coarse filter 22, which is preferred, is also illustrated in U.S. Pat. No. 5,849,188. While the specific design of the three components shown in FIG. 1 can be preferably made as illustrated in U.S. Pat. No. 5,849,188, other constructions for the three layers are within the purview of the invention. For specific applications, different combinations of two of the three layers previously described can be used. For example, the innermost coarse filter 22 can be eliminated. The filter material 20 in some applications can be eliminated. The outer shroud 10 can also be eliminated.

Figure 2:
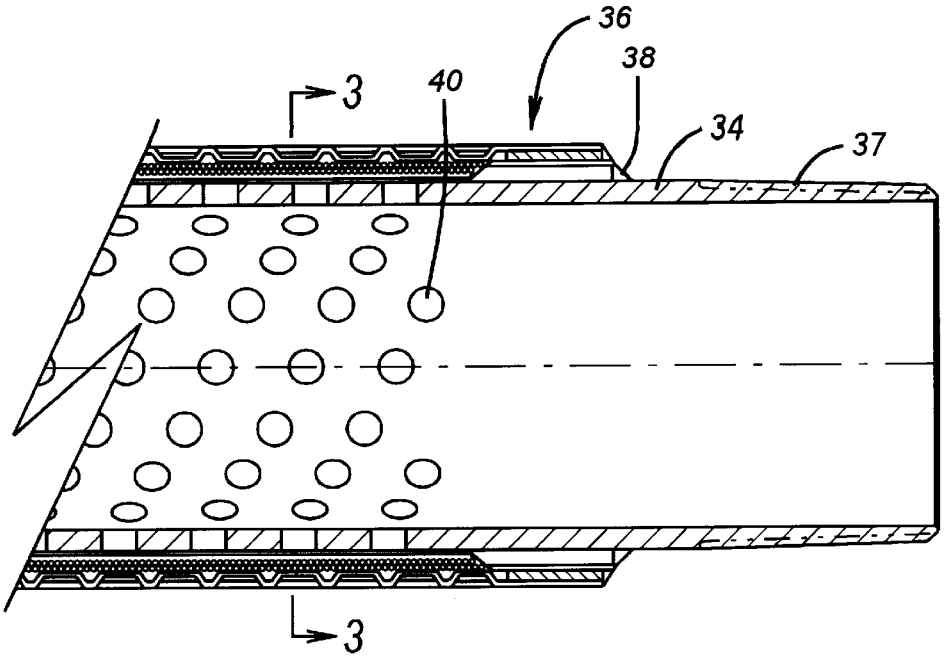
FIG. 2 shows the subassembly after having been advanced through the die and a base pipe inserted and welded thereto.

Referring again to FIG. 1, it can be seen that the assembly is forced through a die 32 which effectively seals the end 30 of the filter material 20 as it is physically compressed between rings 12 and 28. The outer shroud 10 is plastically deformed by the die 32 such that its inwardly directed protrusions 14 are brought into contact with the filter material 20. This contact helps to stabilize the filter material, while the passage through the die 32 seals the subassembly at either end. The entire subassembly shown in FIG. 1 is shown in FIG. 2 with a base pipe 34 extended through it. The base pipe 34 has threaded or other well-known connections 37 at either end, and the subassembly 36 is continuously welded or otherwise joined as indicated at 38. The subassembly of at least two components can also be secured to the base pipe by passing the base pipe through the die with it. The base pipe 34 has a series of openings 40 to complete the filter assembly.

Figure 3:
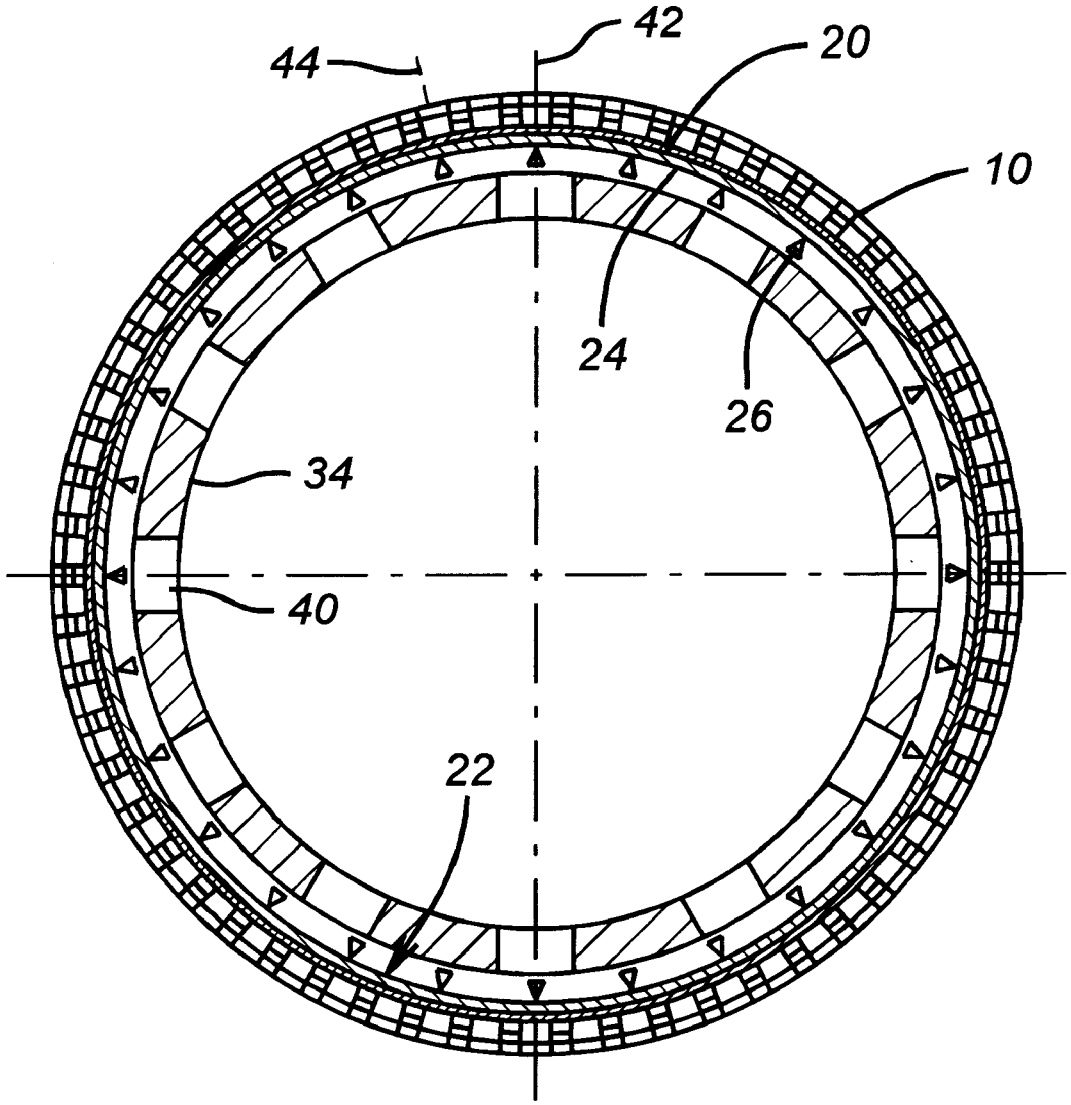
FIG. 3 is a sectional along lines 3—3 of FIG. 2.

FIG. 3 indicates a section through the completed assembly, showing the base pipe 34 with its openings 40. Outside of that are the rods 26 which support the spiral windings of the elongated material 24 to form the coarse filter 22. Outside of that is the filter material 20. Centerline 42, in conjunction with dashed line 44, is intended to graphically show the amount of overlap between the ends of the filter material 20. The overlap is preferably kept to a minimum such as approximately 10° or less which may separate the centerline 42 from the dashed line 44, representing the degree of overlap. The amount of overlap-is sufficient to eliminate the possibility of seam leakage. When the outer shroud 10 is pressed onto the filter material 20 as a result of advancing it through die 32, the overlapping portion between centerline 42 and dashed line 44 are firmly held together against the support of the coarse filter 22.

The advantages of this design should now be readily apparent to those skilled in the art. The close-fit nature of the components, particularly the outer shroud 10 and the filter material 20, allows the assembly to withstand significantly greater differential pressure than the constructions of prior designs, such as that illustrated in U.S. Pat. No. 5,611,399. Differentials in the order of 2000 psi could now be used, whereas with prior designs, the maximum desirable differential pressures were in the order of 600 psi. The need for allowances for differential expansion at the ends of the filter assembly, as illustrated in U.S. Pat. No. 5,611,399, is eliminated. The subassembly 36 is directly secured and sealed to the base pipe 34. Because of the way it is made as described above, differential expansion is no longer a significant issue.

Those skilled in the art can appreciate that with the assembly shown in FIG. 1, the filter material 20 is not structural and thus can be made of a variety of different materials, including plastics, various fabrics or composite materials. The selected material for the filter material 20 needs to be capable of remaining structurally intact, despite advancement of the assembly 36 through the die 32. Similarly, other components of the assembly 36 can be made of nonmetals so as to render the assembly 36 more buoyant. The scope of the invention encompasses any downhole filter assembly made with components that make it buoyant or more buoyant. When the assembly is inserted into a lengthy lateral, its heightened buoyancy can be a significant aid in advancing the assembly 36 to the appropriate position. Clearly, the choice of materials will affect the available differential pressures that the assembly 36 can withstand. Another alternative is to use buoyant materials for the base pipe 34 to accomplish this purpose. The subassembly 36 would then be secured to the base pipe 34 by techniques such as adhesives or other joining compounds which are compatible with the temperatures, pressures and chemicals of the specific application. Thus, for example, the base pipe can be made of glass fiber epoxy composites such as anhydride or aromatic amine-cured epoxy pipe or SDT downhole tubing made by Smith Fiberglass Products Inc. Other types of fiber or polymer matrix can be used to get the requisite strength and abrasion properties in combination with a low density. Some examples are polyphenylene sulfide, polyketones such as PEK or PEEK, epoxy vinyl ester, phenolic resins, bisphenol, A,fumerate, or isophthalic polyester resins. These materials can be combined with carbon fiber, polyester fiber, aramid fiber, glass fiber or other manmade or naturally occurring fiber.

The method of assembly, as illustrated in FIG. 1, further ensures that the filter material 20 is uniformly stressed. The assembly shown in FIG. 2 is sufficiently structurally strong to permit well killing against the screen. As a result of pulling the assembly 36 through the die 32, the filter material acts in a spring-like manner against the outer shroud 10. Alternatively, the coarse filter 22, after pulling through the die 32, can impart spring-like forces to the filter media 20 against the outer shroud 10. The filter material 20 can be a simple mesh or a twill or a porous material and can be made of any one of many materials compatible with well conditions and the mechanical stresses of the application. Buoyant materials can also be used.

Those skilled in the art will appreciate that apart from the technique illustrated in FIGS. 1 and 2, a filter assembly can be constructed with sufficiently low density due to the use of composites or other low-density materials so as to allow a filter assembly, regardless of how it is constructed to be more easily inserted into a lengthy lateral due to the buoyancy effect. Thus, a filter material can be attached to a base pipe 34 with or without a shroud such as 10, as one potential assembly that can be used for installation and laterals to take advantage of the buoyant characteristics. Additionally, a low-density material can be used for the outer shroud 10 and it can have openings of various shapes and sizes created by a variety of techniques.

The foregoing disclosure and description of the invention are illustrative and explanatory thereof, and various changes in the size, shape and materials, as well as in the details of the illustrated construction, may be made without departing from the spirit of the invention.

What is claimed is:

1. A downhole filter assembly, comprising:

at least two filtering layers having a tubular shape and mounted one over the other and secured to each other without welding;

said layers comprise and inner and an outer layer;

said inner layer is trapped by virtue of mechanically deforming said outer layer against it;

a perforated base pipe extending through said layers, said layers having ends extending beyond the perforations in said base pipe and fixedly secured to said base pipe.

2. The assembly of claim 1, wherein:

said layers are joined to each other by deformation resulting from an applied force.

3. The assembly of claim 2, wherein:

one of said layers is formed from a sheet rolled into a tubular shape with ends overlapping by less than about 10°.

4. The assembly of claim 2, wherein:

at least one of said layers further comprises end rings, said layers secured at said end rings by a mechanical deformation.

5. The assembly of claim 4, wherein:

said end rings are nonremovably attached to said base pipe to seal the ends of said layers.

6. The assembly of claim 2, further comprising:

a third layer mounted over said two layers wherein, going outwardly from said base pipe, said layers comprise a coarse filter, a fine filter and a perforated protective jacket, and wherein all of said layers are secured to each other on their ends without welding.

7. The assembly of claim 6, wherein:

said filter layers and said protective jacket are secured on said ends by deformation resulting from an applied force.

8. The assembly of claim 7, wherein:

said protective jacket comprises inwardly directed protrusions in contact with said fine filter at spaced locations over its length between said end portions which are secured to said fine filter.

9. The assembly of claim 7, wherein:

said assembly of said coarse and fine filters and said protective jacket are nonremovably attached on said ends to said base pipe.

10. The assembly of claim 6, wherein:

said fine filter comprises of a sheet of screen material rolled into a tubular shape with ends overlapping by less than about 10°.

11. The assembly of claim 6, wherein:

said protective jacket contacts said fine filter between said ends and said filter assembly can resist internal burst pressure of over about 1000 psig.

12. A downhole filter assembly, comprising:

at least two filtering layers having a tubular shape and mounted one over the other and secured to each other without welding;

a perforated base pipe extending through said layers, said layers having ends extending beyond the perforations in said base pipe and fixedly secured to said base pipe;

said layers are joined to each other by deformation resulting from an applied force;

a third layer mounted over said two layers wherein, going outwardly from said base pipe, said layers comprise a coarse filter, a fine filter and a perforated protective jacket, and wherein all of said layers are secured to each other on their ends without welding;

said fine filter comprises of a sheet of screen material rolled into a tubular shape with ends overlapping by less than about 10°;

said protective jacket and said coarse filter comprise end rings with said fine filter extending in between;

said fine filter being squeezed between said rings on both ends to hold the assembly of said filter and protective jacket together.

13. The assembly of claim 12, wherein:

said protective jacket comprising projections oriented toward said fine filter which are in contact, at spaced locations, with said fine filter between said end rings.

14. A method of running in a screen for downhole use, comprising:

assembling a screen to tubing for running into a wellbore;

providing said screen from materials that enhance buoyancy as compared to steel construction;

using said buoyancy to enhance advancement of said screen downhole;

advancing the screen downhole.

15. The method of claim 14, further comprising:

providing portions of said screen in nonmetal materials.

16. The method of claim 15, further comprising:

providing the entirety of said screen in nonmetal materials.

17. The method of claim 15, further comprising:

providing a portion of said screen in composite materials.

18. The method of claim 15, further comprising:

providing a perforated base pipe, a coarse screen and a fine screen as said screen;

providing one or more of said base pipe, coarse screen and fine screen in a nonmetal material.

19. A The method of claim 18, further comprising:

providing at least one of said base pipe, coarse screen and fine screen in fiber epoxy composite material.

* * * * *